United States Patent [19]

Stadler et al.

[11] 4,181,835

[45] Jan. 1, 1980

[54] GAS FLOW INDICATOR HAVING A MAGNETIC FIELD SENSITIVE SWITCH THAT IS RESPONSIVE TO THE POSITION OF A MAGNET SECURED TO A PISTON

[76] Inventors: Gary D. Stadler, 5459 Moonlight La., La Jolla, Calif. 92035; Patrick H. Chambers, 8318 Robbie Way, Lemon Grove, Calif. 92045; John W. Bowden, 2936 Fairfield St., San Diego, Calif. 92110

[21] Appl. No.: 890,389

[22] Filed: Mar. 27, 1978

[51] Int. Cl.[2] ..... H01H 35/38

[52] U.S. Cl. ..... 200/82 E; 340/610; 340/611; 73/745

[58] Field of Search ..... 335/205; 340/606, 610, 340/611; 73/228, 210, 745; 200/82 E, 81.9 M; 205/82

[56] References Cited

U.S. PATENT DOCUMENTS

| | | | |
|---|---|---|---|
| 2,041,726 | 5/1936 | Pray | 73/210 |
| 2,734,960 | 2/1956 | Reynolds | 340/610 |
| 2,963,563 | 12/1960 | Patterson | 200/81.9 M |
| 3,363,073 | 1/1968 | Bouguet | 200/81.9 M |
| 3,515,827 | 6/1970 | Beeken | 200/81.9 M |
| 3,766,779 | 10/1973 | Hoffman | 73/228 |
| 3,910,112 | 10/1975 | Gerlach | 73/210 |
| 3,941,957 | 3/1976 | Tilman | 200/82 R |

OTHER PUBLICATIONS

Air flow or air pressure sensing device, Brodsky, Poe and Bischoff, IBM Tech. Discl. Bull., vol. 9, No. 6, Nov. 66, pp. 624.

*Primary Examiner*—Gerald P. Tolin
*Attorney, Agent, or Firm*—Brown & Martin

[57] ABSTRACT

A gas flow indicator including an open-ended cylinder, a piston constrained within the cylinder to move between the ends thereof, and a reed switch positioned on the outside of the cylinder for responding to the position of a magnet secured to the piston is disclosed. The piston is closed at its end adjacent the output aperture of the cylinder and is open at its end adjacent the input aperture of the cylinder for defining a basin within the piston. A spring is positioned between the piston and the output aperture for forcing the piston away from the output aperture. Gas flowing in through the input aperture forces the piston toward the output aperture. An indication of the state of gas flow through the cylinder is provided in accordance with whether the switch is open or closed. The dimensions of the inner chamber in relation to the dimensions and positioning of the piston prevent oscillation of the piston at its position of equilibrium determined by the rate of gas flow and thereby prevents oscillations in the indication provided by the switch and also enables the gas flow indicator to respond to a wide range of gas flow rates.

3 Claims, 7 Drawing Figures

GAS FLOW INDICATOR HAVING A MAGNETIC FIELD SENSITIVE SWITCH THAT IS RESPONSIVE TO THE POSITION OF A MAGNET SECURED TO A PISTON

BACKGROUND OF THE INVENTION

The present invention generally pertains to apparatus for indicating that gas is flowing through a line, and is particularly directed to an improvement in such apparatus of the type wherein an electrical signal indication is enabled by the opening or closing of a switch in an electrical circuit in accordance with the state of gas flow through the line.

The best known prior art gas flow indicator of this type is shown in cross-section in FIG. 1. This prior art gas flow indicator includes a cylinder 10, a piston 11, a sleeve 12, a cylinder body 13, a first magnet 14, a second magnet 15, a cylinder cap 16, a switch device 17, an adjustment screw assembly 19, a mechanical spring 20, a first grommet 21, and a second grommet 22. The cylinder 10 has an input aperture 24 and an output aperture 25 that communicates with an inner chamber 26. The cylinder 10 also defines a cavity 28 for holding the switch device 17, the adjustment screw assembly 19, and the mechanical spring 20.

This gas flow indicator apparatus is positioned in a gas line in which a flow indication is desired, so that gas flowing through the line enters the gas flow indicator through the input aperture 24.

The piston 11 is contained within the sleeve 12 within the inner chamber 26 and is constrained for movement within the inner chamber 26.

The first magnet 14 is secured to the end of the piston adjacent the output aperture 25, and the second magnet 15 is secured to the end of the cap 16 that is adjacent the piston 11. The first magnet 14 and the second magnet 15 cooperate with one another to function as a spring in order to force the piston 11 away from the output aperture 25.

The cap 16 is positioned at the output aperture end of the cylinder 10. The cap 16 contains a plurality of channels 29 for enabling gas to flow out of the inner chamber 26 to the output aperture 25.

The switch device 17 includes a reed switch, which is sensitive to a magnetic field, in that it is closed in response to the presence of a closely adjacent magnetic field.

Gas flowing in through the input aperture forces the piston 11 toward the output aperture, thereby changing the position of the first magnet 14 in relation to the position of the reed switch in the switch device 17. The reed switch is thus either open or closed in accordance with the position of the magnet 14, which is in turn dependent upon the state of gas flow through the line. Thus, when the reed switch is connected in an electrical circuit (not shown) the indication provided at terminals 31 and 32 connected to the reed switch in accordance with whether the reed switch is opened or closed is an indication of the state of gas flow through the cylinder 10.

This prior art gas flow indicator has the disadvantage of being quite complex and thereby expensive to manufacture. Also, it does not respond when the gas flow rate is quite low.

SUMMARY OF THE INVENTION

The present invention provides an improvement over the best known prior art gas flow indicator described above in that it is less complex construction and thereby less expensive to manufacture. It also is responsive to gas flow when the rate of flow is quite low. The gas flow indicator of the present invention consists of a cylinder, a piston, a spring, a magnet, and a switch.

The cylinder has an input aperture and an output aperture and defines a generally cylindrical inner chamber between the apertures. The gas flow indicator of the present invention is positioned in a gas line so that gas flowing through the line enters the cylinder through the input aperture. The piston is cylindrical. The piston is constrained within the inner chamber for movement between the input aperture and the output aperture. Gas flowing in through the input aperture forces the piston toward the output aperture. The spring is positioned between the piston and the output aperture for forcing the piston away from the output aperture. The magnet is secured to the piston. The switch is a magnetic field sensitive switch that is positioned on the outside of the cylinder for being closed by the magnetic field of the magnet upon movement of the piston within the cylinder to a predetermined positioned dependent upon a predetermined force of gas flow in through the input aperture. Accordingly, an indication of the state of gas flow through the cylinder may be provided in accordance with whether the switch is open or closed.

The inside diameter of the inner chamber in the region adjacent the input aperture is only slightly larger than the outside diameter of the piston for enabling gas flowing in through the input aperture to force the piston toward the output aperture end of the inner chamber and for enabling gas flowing in through the input aperture to flow past the piston and out through the output aperture when the piston is forced to the output aperture end of the inner chamber. The inside diameter of the inner chamber in the region adjacent the output aperture is substantially larger than the outside diameter of the piston, with the transition in the size of the diameter of the inner chamber being defined by a step adjacent a position occupied by the piston notwithstanding how close the piston is to the output aperture, to thereby decrease the rate at which the piston is moved toward the output aperture in response to the flow of the gas as the rate of gas flow is increased while maintaining continued movement of the piston toward the output aperture, and to thereby damp variations in piston movement at the endpoint of a movement of the piston to a position of equilibrium determined by the rate of gas flow. The dimensions of the inner chamber in relation to the dimensions and positioning of the piston prevent oscillation of the piston at its position of equilibrium determined by the rate of gas flow and thereby prevents oscillations in the indication provided by the switch and also enables the gas flow indicator to respond to a wide range of gas flow rates.

Additional features of the present invention are described in connection with the description of the preferred embodiment.

DESCRIPTION OF THE PREFERRED EMBODIMENTS

Figure 4A:
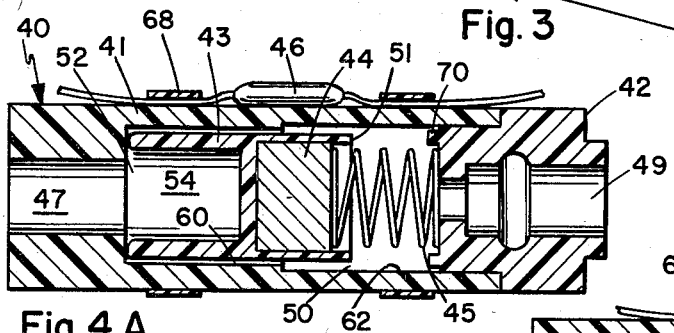
FIGS. 4A and 4B are enlarged cross-sectional views taken along lines 4—4 of FIG. 2 showing the piston in two different positions.
Figure 4B:
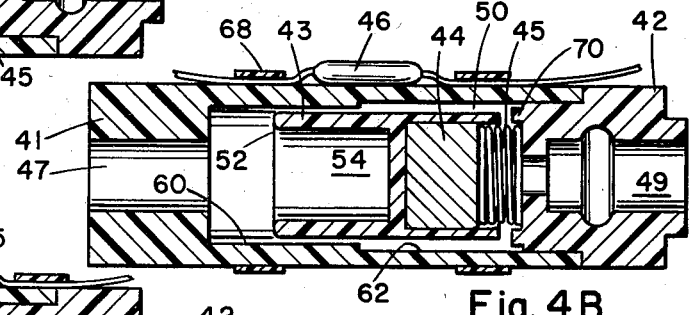

Referring to FIGS. 2,3,4A and 4B, one preferred embodiment of a gas flow indicator according to the present invention includes an unthreaded cylinder 40, having a body 41 and a cap 42, a piston 43, a magnet 44, a spring 45, and a reed switch 46. For purposes of assembling the piston 43 the magnet 44 and the spring 45 within the cylinder body 41, the cap 42 is removable from the cylinder body 41. Normally the cap 42 is tightly fitted by an adhesive within the body 41 as shown in FIGS. 4A and 4B.

The cylinder 40 has an input aperture 47 and an output aperture 49 and defines a generally cylindrical inner chamber 50 between the apertures 47, 49. The piston 43 is cylindrical. The piston 43 is constrained within the inner chamber 50 for movement between the input aperture 47 and the output aperture 49. The piston 43 is closed at its end 51 adjacent the output aperture 49 and is open at its end 52 adjacent the input aperture 47 for defining a basin 54 within the piston 43, whereby gas flowing in through the input aperture 47 forces the piston 43 toward the output aperture 49.

Figure 1:
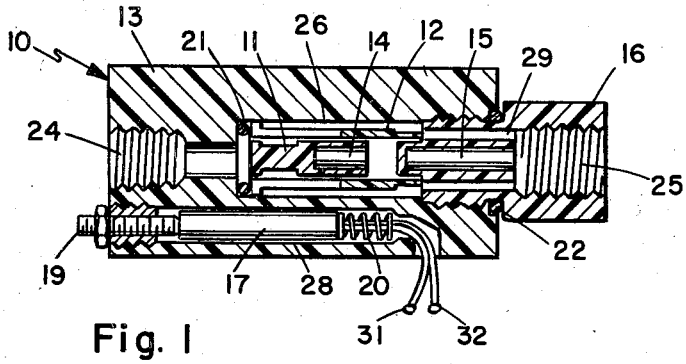
Fig. 1 PRIOR ART
FIG. 1 is a cross-sectional view of a prior art gas flow indicator.
Figure 2:
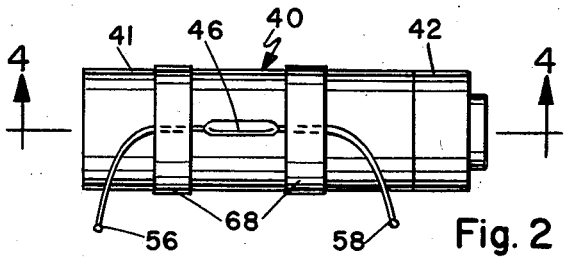
FIG. 2 is a plan view of the gas flow indicator of the present invention.
Figure 3:
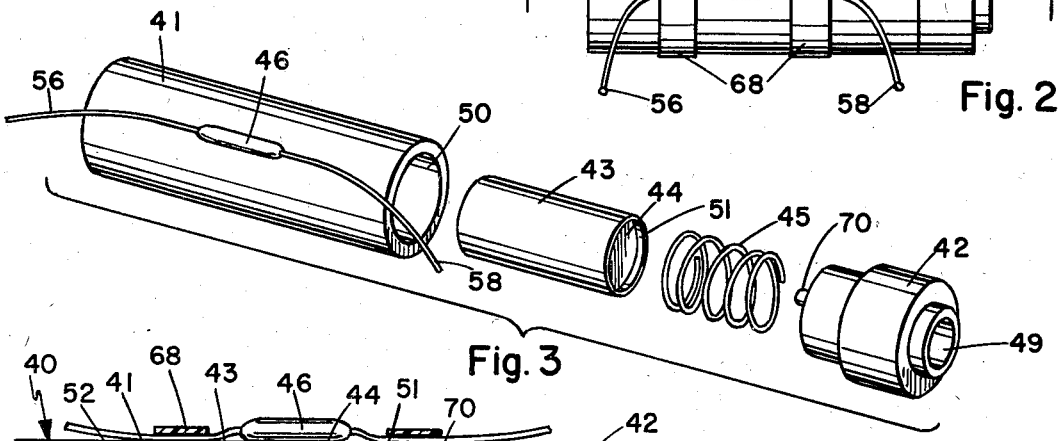
FIG. 3 is an exploded perspective view illustrating the components of the gas flow indicator of FIG. 2.

The spring 45 is a mechanical spring that is positioned between the piston 43 and the output aperture for forcing the piston 43 away from the output aperture 49. A magnetic spring such as is shown in the prior art device of FIG. 1 could be substituted for the mechanical spring 45, if desired.

The magnet 44 is secured within the piston 43 at its closed end 51.

The reed switch 46 is a magnetic field sensitive switch. The switch 46 is positioned on the outside of the cylinder 40 for being closed by the magnetic field of the magnet 44 upon movement of the piston 43 within the cylinder 40 to a predetermined positioned dependent upon a predetermined force of gas flow in through the input aperture 47. FIG. 4A depicts the situation in which no gas is flowing through the cylinder 40. The piston 43 is forced by spring 45 to its position within the cylinder closest to the input aperture 47. In this position (FIG. 4A), the magnet 44 is adjacent the reed switch 46 and thereby causes the reed switch 46 to be closed.

Figure 5A:
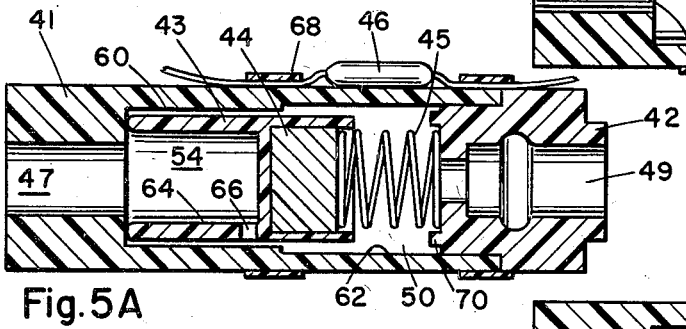
FIGS. 5A and 5B are like FIGS. 4A and 4B except that they illustrate a different embodiment of the piston and different placement of the switch.
Figure 5B:
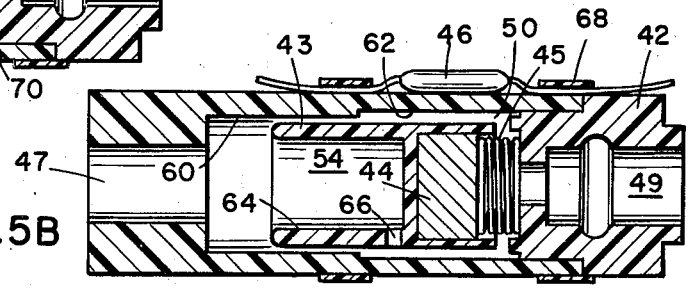

FIG. 4B depicts the situation in which gas is flowing through the cylinder 40. Gas flows into the basin 54 and forces the piston 43 toward the output aperture 49. In this position (FIG. 4B), the magnet 44 is not adjacent the reed switch 46 and the reed switch 46 is opened. Alternatively the reed switch 46 can be positioned on the outside of the cylinder 40 to be closed when the magnet 44 is in the position shown in FIG. 4B and opened when the magnet is in the position shown in FIG. 4A. Such an alternative placement of the reed switch 46 is illustrated in FIGS. 5A and 5B.

It is seen that the reed switch 46 is either open or closed in accordance with the position of the magnet 44, which is in turn dependent upon the state of gas flow through the cylinder 40. Thus, when the reed switch 46 is connected via its terminals 56 and 58 in an electrical circuit (not shown), the indication provided at terminals 56 and 58 in accordance with whether the reed switch 46 is opened or closed is an indication of the state of gas flow through the cylinder 40.

The reed switch 46 is secured to the outside of the cylinder 40 by adhesive tape 68.

The piston 43 has a uniform outside diameter. The inner chamber 50 has a diameter in the region 60 adjacent the input aperture 47 that is only slightly larger than the outside diameter of the piston 43 for enabling the piston 43 to move within the inner chamber 50, for enabling gas flowing in through the input aperture 47 to force the piston 43 toward the output aperture 47 to force the piston 43 toward the output aperture end of the inner chamber 50, even when the flow rate is quite low, and for enabling gas flowing in through the input aperture 47 to flow past the piston 43 and out through the output aperture 49 when the piston 43 is forced to the output aperture end of the inner chamber 50. The inner chamber 50 has a diameter in the region 62 adjacent the output aperture 49 that is substantially larger than the outside diameter of the piston 43. The transition in the size of the diameter of the inner chamber 50 is defined by a step adjacent a position occupied by the piston 43 notwithstanding how close the piston is to the output aperture to thereby decrease the rate at which the piston 43 is moved toward the output aperture 49 in response to the flow of the gas as the rate of gas flow is increased while maintaining continued movement of the piston 43 toward the output aperture 49, and to thereby damp variations in piston movement at the endpoint of a movement of the piston 43 to a position of equilibrium determined by the rate of gas flow. This larger diameter in the region 62 is also significant in the alternative preferred embodiment shown in FIGS. 5A and 5B; wherein the side wall 64 of piston 43 contains a small aperture 66 communicating from the basin 54 to the outside of the piston 43 adjacent the closed end 51 of the piston 43 for enabling gas to flow from within the basin 54 to the region 62 of the inner chamber 50 having the substantially larger inside diameter when the piston 43 is forced by gas flow to the output aperture end of the inner chamber 50.

Preferably, the outside diameter of the piston 43 is 0.600 inch, the diameter of the inner chamber 50 in the region 60 adjacent the input aperture 47 is $0.602+0.001$, $-0.00001$ inch, and the diameter of the inner chamber in the region 62 adjacent the output aperture 49 is 0.606 inch. In this embodiment the clearance between the piston 43 and the region 60 of the inner chamber 50 is approximately $0.002\pm0.001$ inches.

The cap 42 includes a pair of oppositely disposed nubs 70 which are in alignment with the rim of the piston 43 at its end 51 for preventing the end 51 of the piston 43 from sealing against the cap 42 when the gas flow rate is high and the piston is fully forced toward the output aperture 49.

We claim:

1. A gas flow indicator, comprising a cylinder having an input aperture and an output aperture and defining a generally cylindrical inner chamber between the apertures;

a cylindrical piston constrained within the inner chamber for movement between the input aperture and the output aperture, whereby gas flowing in through the input aperture and out the output aperture goes around the piston and also forces the piston toward the output aperture;

a spring positioned between the piston and the output aperture for forcing the piston away from the output aperture;

a magnet secured to the piston; and a magnetic field sensitive switch positioned on the outside of the cylinder for being closed by the magnetic field of the magnet upon movement of the piston within the cylinder to a predetermined position dependent upon a predetermined force of gas flow in through the input aperture;

whereby an indication of the state of gas flow through the cylinder may be provided in accordance with whether the switch is open or closed;

wherein the inside diameter of the inner chamber in the region adjacent the input aperture is only slightly larger than the outside diameter of the piston so that gas flowing in through the input aperture forces the piston toward the output aperture end of the inner chamber and flows around and by the outside of the piston in said slightly larger diameter region; and wherein the inside diameter of the inner chamber in the region adjacent the output aperture is substantially larger than the outside diameter of the piston, with the transition in the size of the diameter of the inner chamber being defined by a step adjacent a position occupied by the piston notwithstanding how close the piston is to the output aperture, to thereby decrease the rate at which the piston is moved toward the output aperture in response to the flow of the gas as the rate of gas flow is increased while maintaining continued movement of the piston toward the output aperture, and to thereby damp variations in piston movement at the endpoint of a movement of the piston to a position of equilibrium determined by the rate of gas flow.

2. A gas flow indicator according to claim 1, wherein the piston is closed at its end adjacent the output aperture and is open at its end adjacent the input aperture for defining a basin within the piston, and the side wall of the piston contains a small aperture communicating from the basin to the outside of the piston adjacent the closed end of the piston for enabling gas to flow from within the basin to the region of the inner chamber having said substantially larger inside diameter when the piston is forced by gas flow to the output aperture end of the inner chamber.

3. A gas flow indicator according to claim 1, wherein the piston has a rim at its end adjacent the output aperture, and the cylinder has a cap at its output aperture end, and the cap includes a pair of oppositely disposed nubs which are in alignment with the rim of the piston for preventing the end of the piston from sealing against the cap when the gas flow rate is high and the piston is fully forced toward the output aperture.

* * * * *